US005199814A

United States Patent [19]

Clark et al.

[11] Patent Number: 5,199,814

[45] Date of Patent: Apr. 6, 1993

[54] IMPACT RECOVERY DELINEATION SYSTEM

[75] Inventors: Richard O. Clark, Austin; Richard M. Milton, San Antonio, both of Tex.

[73] Assignee: Flexco, Austin, Tex.

[21] Appl. No.: 667,185

[22] Filed: Mar. 8, 1991

Related U.S. Application Data

[63] Continuation-in-part of Ser. No. 664,000, Jan. 18, 1991, abandoned.

[51] Int. Cl.[5] ..... E01F 9/00

[52] U.S. Cl. ..... 404/10; 40/608; 116/63 P

[58] Field of Search ..... 404/10, 11, 12; 40/606, 40/607, 608; 116/63 P, 63 R

[56] References Cited

U.S. PATENT DOCUMENTS

| | | | |
|---|---|---|---|
| 3,380,428 | 4/1968 | Abrams | 404/10 X |
| 3,478,714 | 11/1969 | Keats | 404/10 X |
| 3,485,201 | 12/1969 | Kelley | 404/10 X |
| 3,499,413 | 3/1970 | Heard | 404/10 X |
| 3,705,566 | 12/1972 | Duckett et al. | 40/608 X |
| 3,802,135 | 4/1974 | Weichenrieder | 404/10 X |
| 4,019,271 | 4/1977 | Latimer | 40/607 X |
| 4,038,769 | 8/1977 | Werner | 40/608 X |
| 4,766,686 | 8/1988 | Glasener | 40/608 X |
| 4,806,046 | 2/1989 | Clark | 404/10 |

*Primary Examiner*—Ramon S. Britts

*Assistant Examiner*—Roger J. Schoeppel

*Attorney, Agent, or Firm*—Gunn, Lee & Miller

[57] ABSTRACT

An impact recovery delineation system comprises a base member that provides improved mechanical and chemical bonding to the road surface and a portable base that provides a rigid center portion and flexible ends to maintain the position of the delineator device after vehicle impact. A sealed, pneumatic tube of high impact resistant material composition acts as a delineator post and is adapted to receive modified load cells. Upper and lower load cell elements are provided with cable passages to allow side-by-side placement of wire rope cables. The passages are particularly geometrically configured and have two radiused edges and two straight edges which result in rapid bending and recovery of the delineator post system upon high speed impact, in any direction, by an automotive vehicle. A vented signage panel having air vents therein to reduce wind resistance, improve and speed recovery of the impacted system. A safety loop in the cable system is provided to prevent the delineator post and signage from being separated from the load cell abutment base connection should there be a structural failure at this connection. A flexible portable base structure is provided for temporary location of delineation posts and which is provided with an intermediate stiffener and flexible weighted ends to prevent its lifting from the roadway upon vehicle impact with the impact recovery delineator post system supported thereby.

29 Claims, 7 Drawing Sheets

IMPACT RECOVERY DELINEATION SYSTEM

This application is a continuation-in-part application of copending application Ser. No. 07/644,000, filed Jan. 18, 1991, entitled DELINEATOR POST SYSTEM, now abandoned.

BACKGROUND OF THE INVENTION

The present invention relates to an impact recovery delineation system comprised of a pneumatic delineator post, a vented signage panel and a fixed or portable base system which facilitates pivoting from a normally aligned, upright position to a substantially horizontal position upon being impacted by a moving object such as an automotive vehicle. More specifically, this invention relates to a self-uprighting, pneumatic delineator post, vented panel and base system constructed with unique load cell elements designed to reduce the impact force required to pivot the post on impact and to speed the return of the post to its upright position.

U.S. Pat. No. 4,806,046 teaches the current state of the art for such devices. However, certain problems still exist with existing posts, and specifically those taught in U.S. Pat. No. 4,806,046, which the present invention seeks to overcome. The improvements of the present system allow for greater post survival rates upon repeated impact at a wide range of vehicular speeds with minimal damage to the impacting vehicle.

Delineator posts for marking travel ways and identifying the existence of hazardous objects are typically constructed of lengths of formed metal sheet material or bar stock which are concreted or otherwise fixed to the ground or to other stationary objects. Recently high impact plastics or polymers have been used to provide flexible delineator posts that have the capability of recovering to their near original condition after being struck and bent by vehicle collision. Polymer posts are typically provided with light reflectors to facilitate identification at night and are appropriately colored for good visibility during daylight hours.

It is well known that delineator posts are frequently accidentally struck by automotive vehicles that for one reason or another leave the designated travel way. Once struck, the delineator posts, especially those composed of metal, are typically bent to the extent that they are thereafter unusable. Additionally, because the posts are somewhat rigid, there is a likelihood that the automotive vehicle will also be damaged by impact with a delineator post. The replacement cost of delineator posts is a major expense of travel way maintenance.

The use of a delineator post system as taught in U.S. Pat. No. 4,806,046 has significantly reduced these maintenance costs. Delineator posts composed of high impact polymer materials have been found more resistant to damage as compared to metal posts but it has also been found that such polymer posts will not absorb high impact pressure without heavy deformation or dislodging. At typical vehicular speeds and especially at high speeds the presently used polymer delineator posts typically suffer considerable damage and tend to wrap against the impacting vehicle and become dislodged from their supporting surfaces. It is desirable, therefore, to provide an impact recovery delineation system that will not be destroyed upon impact by an automotive vehicle traveling at typical highway speeds and which is more likely to result in less damage to the automotive vehicle as the result of accidental collision. It is desirable, therefore, to provide an impact recovery delineation system which will yield both structurally and mechanically when impacted by an automotive vehicle and which, after passage of the automotive vehicle, will return quickly to its upright position, properly aligned, and in a substantially undamaged condition, while at the same time minimizing the vehicle damage that would otherwise occur.

Most delineator posts are permanently mounted at specific locations, such as being concreted in the ground, epoxied to stationary objects, or driven into the ground. In situations where temporary road maintenance or traffic conditions warrant, stand-alone travelway delineation in the form of cones or barrels are utilized. When such stand-alone devices are struck, not only is there typically an occurrence of flying debris, but the damaged or displaced cone or barrel frequently comes to rest in the way of oncoming traffic, thereby creating an even greater hazard. Consequently, it is desirable to provide a stand-alone, portable delineation system which will yield when impacted, but not significantly move from its intended position or orientation on the highway.

SUMMARY OF THE INVENTION

The present invention provides an impact recovery delineation system that is capable of being struck many times at a wide range of vehicle speeds without significant damage and while at the same time minimizing damage to automotive vehicles during such accidental striking.

The present invention also provides a novel pneumatic, sealed delineator post tube having the capability of becoming more rigid during collision induced structural deformation and bending due to increased internal air pressure so that the delineator post has controlled flexibility during collision, thus enhancing its structural integrity and promoting its longevity. This invention also provides a unique load cell incorporating one or more springs under compression which together provide a significant amount of stiffness to resist forces applied thereto without becoming overstressed.

This invention further provides a novel delineator post system including a load cell which enables the post to be more easily pivoted at the load cell upon being impacted and the more quickly returned as nearly as practical to its pre-impact position to thus insure against misorientation of reflectors and other objects that are supported by the post.

This invention also provides a novel impact recovery delineation system incorporating a load cell providing significant stiffness to the post to prevent inadvertent yielding or fluttering due to windy conditions and yet provides a post construction that yields readily to impacts without being damaged or causing significant damage to the automotive vehicle.

The delineator impact recovery system of this invention provides for selective use of a portable post support base which may be temporarily positioned on an adjacent vehicle travelway and which has controlled weight and flexibility so that under conditions of collision, even severe collision such as a direct vehicle wheel strike, the delineator system will yield and recover from collisions without significant damage to the delineator post, signage, and base and with minimal damage if any to the vehicle.

Briefly, the present invention provides a unique combination of pneumatic post structure, radiused edges along abutting faces of the load cell elements, and a permanent base or portable base. Signage affixed to the post structure is further provided with air venting perforations to reduce wind resistance and to improve and speed of recovery of the impacted system.

This invention is directed to an impact recovery delineation system having a tubular pneumatically sealed post which is supported on the ground or by a stationary object and includes a lower part or base which may be placed on or in the ground, bolted to a stationary object (bridge deck or concrete pavement, concrete medium barrier, etc.) or epoxied to a stationary object (bridge deck, curb, asphaltic concrete pavement, concrete pavement, etc.). A portable base is also provided which enables temporary travelway delineation to be quickly established, changed or removed as suits the needs of changing construction sites.

Work zone traffic control devices provided according to this invention will perform very well in vehicle collisions. The impacting vehicle will exhibit very stable behavior during impact with these traffic control devices and will not pose any potential threat to traffic in adjacent lanes. The vehicle will sustain very minor damage with low potential for serious occupant injury. There will generally be no debris or detachments from the traffic control devices to pose any potential hazard to the impacting vehicle, adjacent traffic, or workers in construction zones. The spring-loaded mechanism will successfully return the traffic control devices to their pre-impact positions and damage sustained by the traffic control devices will be limited mostly to bend panels and scrapes in the reflective sheeting, which should not significantly affect the functionality of the traffic control devices.

The sealed tube polymer post of the invention is designed to receive the initial impacting force from the vehicle. Because air within the tube is compressed during deformation and bending of the post, it tends to urge the tube back into its original shape and to push the tube away from the impacting vehicle. In accordance with the present impact recovery delineation system, the energy is transferred to a non-deforming mechanical device to do what plastics cannot. The polymer posts have a greater wall thickness than most of the flexible systems presently in use and thus provide a post which is typically more rigid in comparison, however, the present impact recovery system is rendered more effective than conventional systems because of that transfer from chemical or polymeric strength to mechanical strength (with the pneumatic reinforcement).

The impact recovery delineation system incorporates a load cell which forms a pivoting joint and an upper part which extends upwardly above the ground, curb, roadway surface, concrete medium barrier or bridge deck. The upper part is adapted to pivot about the lower part preferably in one direction by means of a pivoting joint when subjected to an impact force from any direction.

The pivoting joint includes a restoring means for returning the post to its normally aligned upright position following cessation of the impact force. The load cell resists rotation relative to the base during pivoting movement and thus returns the delineator post to its properly oriented position upon uprighting of the post. The delineator post is capable of being moved from its upright position to a position in excess of 90° and yet returned to its original upright alignment. The delineator post incorporates a load cell construction employing one or two spring members maintained in compression by a flexible cable system that permits at least 90° bending of the delineator post upon impact.

The cable system employs two spring tensioned cables which travel inside a unique slot of elongated cross-sectional configuration which extends through the upper and lower parts of the load cell along the x-axis which prevents rotation of the post about the x-axis. This feature prevents the cables from rotating and becoming unwound when impacted and thereby prevents the cables from releasing the compression on the spring that keeps the delineator post rigid and upright.

The load cell incorporates a pair of cooperating beveled load cell elements which interfit both when the load cell is upright and when it is yielded 90° by an impact force. An important improvement to each load cell element is the incorporation of radiused edges on the flat abutting faces of the elements.

The delineator post assembly incorporates a surface mounted base member which can be secured to the ground or easily secured to various fixed objects and surfaces which are commonly found on and about roadways. The base incorporates specifically designed and arranged ports or openings and channels for retaining epoxy materials to significantly improve adhesion and fixation of the delineator system to the mounting surface.

An alternative stand-alone, portable embodiment of the system utilizes a rubber (rubber means an elastic material and could include PVC or other synthetic materials that have elastic properties) base member which has a rigid center portion and flexible ends to cooperate with the cable tensioning system to maintain the position of the delineator device on the highway when impacted by a motor vehicle.

The present inventive system incorporates a signage member or panel having air vents therein to reduce wind resistance, and improve and speed recovery of the impacted system.

A safety loop is provided on the cable system to prevent the delineator post and signage from being separated from the load cell element/base connection should there be a structural failure at this connection.

Though this invention is discussed herein particularly with regard to is application for roadway traffic delineation, such is not intended to limit the spirit and scope of the invention. Upon an understanding of the invention many other uses will come to mind, for example aviation markers. Taxiways, runways, parking areas and the like may be provided with impact recovery delineation to withstand collisions and jet blasts and the like while continually maintaining delineation control.

Other and further features of the invention will become apparent to one skilled in the art upon a review of the detailed description, claims and drawings which form this patent specification.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is an elevational view of the impact recovery delineation system that is constructed in accordance with the principals of the present invention.

FIG. 2A is an elevational view of the delineator post system of the present invention illustrating the yielding position of the post after being accidentally struck and forced from its vertical position.

FIG. 2B is an elevational view of the delineator post system of the present invention illustrating the yielded position of the post.

FIG. 2C illustrates a vehicle impacting a highly flexible unsealed post.

FIG. 3 is a partial sectional view of the delineator post system, taken along line 3—3 of FIG. 1.

FIG. 4A is a top, side perspective view of the lower load cell element of the present invention.

FIG. 4B is an elevational plan of the lower load cell element of the present invention.

FIG. 4C is a top view of the lower load cell element of the present invention.

FIG. 4D is a bottom view of the lower load cell element of the present invention.

FIG. 5 is a partial sectional view of a delineator post system taken along line 5—5 of FIG. 3.

FIG. 6A is an elevational plan view of the base of an embodiment of the present invention.

Figure 6A:
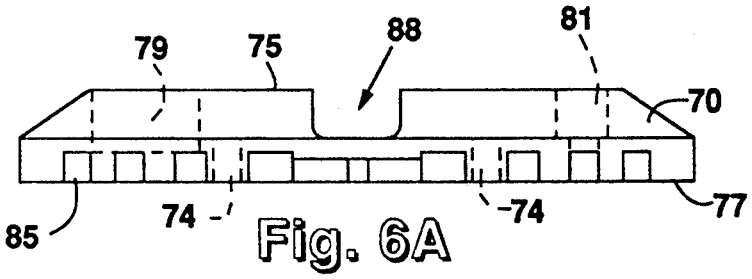
Figure 6B:
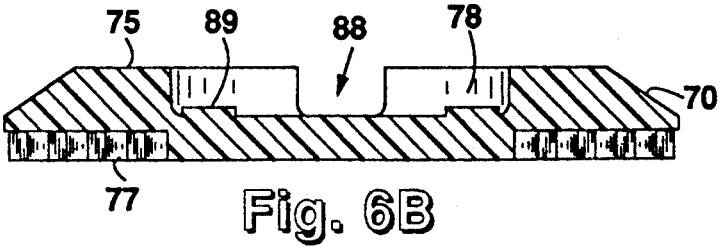

FIG. 6B is a cross-sectional view of the base of an embodiment of the present invention.

Figure 7:
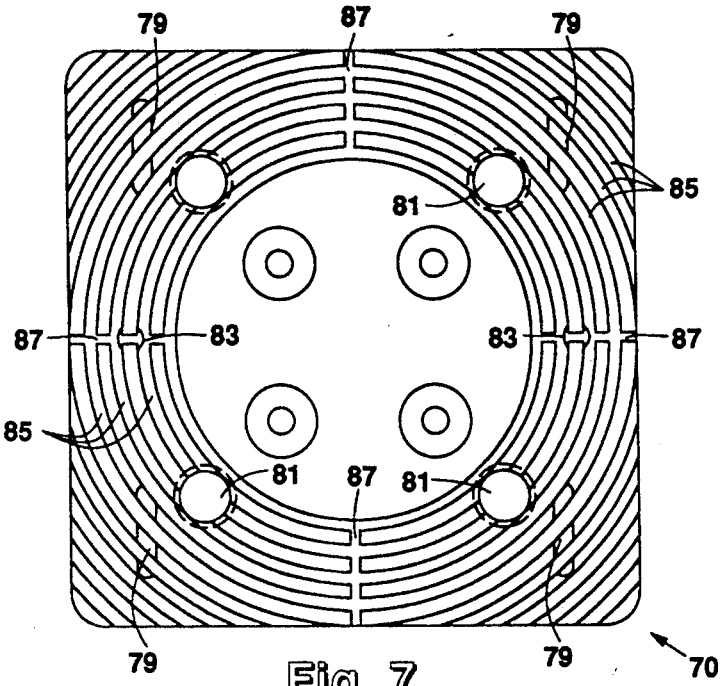

FIG. 7 is a bottom view of the base of an embodiment of the present invention.

Figure 8:
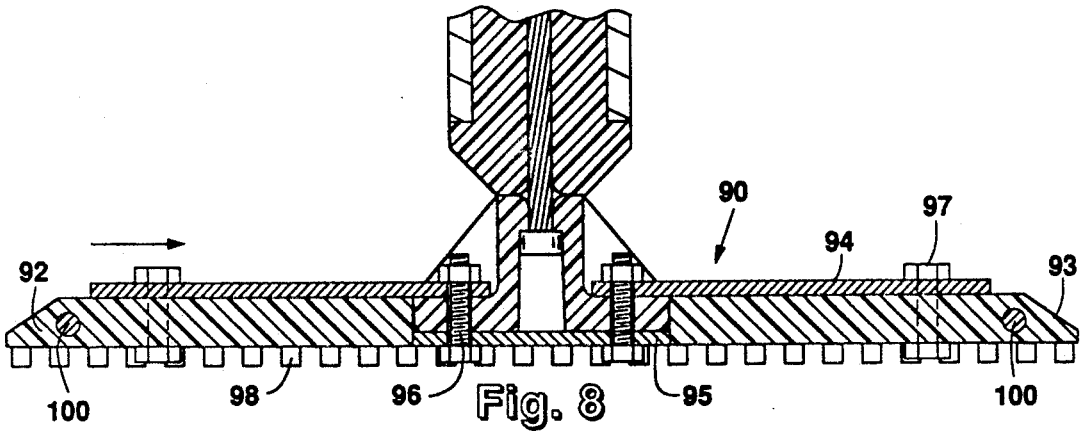

FIG. 8 is a partial sectional view of a stand-along, portable embodiment of the present invention.

Figure 9:
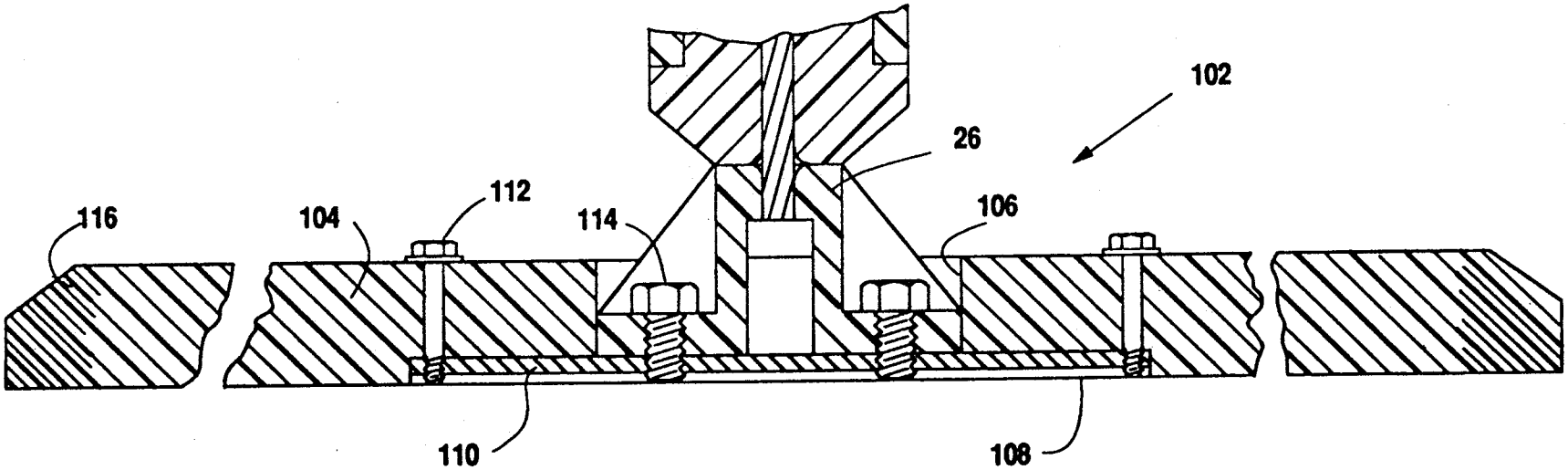

FIG. 9 is a sectional view shown in elevation, illustrating an alternative embodiment of the portable base portion of the present invention.

DETAILED DESCRIPTION OF PREFERRED EMBODIMENTS

Figure 1:
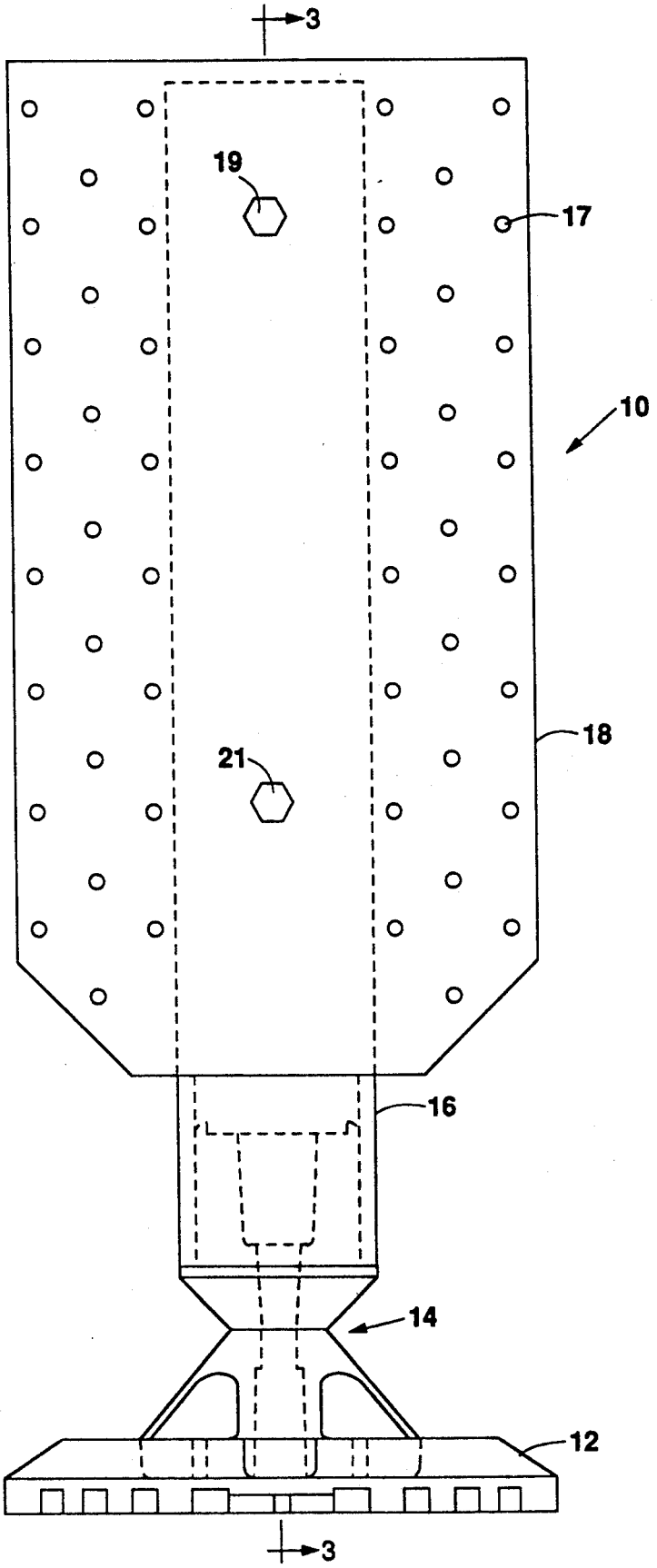

Referring now to the drawings and first to FIG. 1, an impact recovery delineation system constructed in accordance with the teachings of this invention is illustrated generally at 10 and incorporates a base 12, a load cell illustrated generally at 14 and a delineator post 16. The delineator post is provided with a reflective signage panel 18 which may be suitably attached with bolts 19 and 21 to the post to provide reflection of light, thus permitting the post to be readily visible under night driving conditions. The post and the panel may be of a suitable color enabling it to be readily visible during daylight conditions. Signage panel 18 is provided with a multiplicity of air vents 17 extending through the panel. The material composing the post 16 may comprise any one of a number of suitable polymer materials that are impact resistant.

Most delineator posts are constructed of either metal pipe or bar stock. Recent improvements have made the posts of lightweight impact resistant material which is highly flexible and presents little resistance to impact forces. This feature was thought to prevent damage to the post and also prevent damage to the impacting automotive vehicle. However, it has been found through the use of high speed photography that flexible, high impact resistant posts substantially conform to the leading edge of the impacting vehicle. Rather than allowing the pivot joint and the load cell elements to compensate for the impact, the flexible post is "held" against the vehicle by a negative pressure or vacuum condition that is developed on the front or vehicle-facing side as the result of sudden vehicle induced movement tends to cause the post to be pulled or torn from the base or cause the base to be pulled from the ground.

As shown in FIG. 2, the present invention 10 utilizes a post tube 16 composed of high impact resistant material composition. The delineator post is composed of high impact polymer material having a wall thickness that typically exceeds the wall thickness of conventional polymer delineation posts in use at the present time. The post thus exhibits increased rigidity in comparison to conventional delineator posts. This material is impact resistant in that it is not brittle but generally retains its shape and has good memory characteristics. Other materials with similar memory characteristics may be used. The tube is generally sealed at the top 20 (FIG. 3 more clearly illustrates this) by either mechanically crimping or heat sealing or sonically welding the tube end 20. Thus, a delineator post having pneumatic dampening characteristics is created. The lower end 23 of the post tube 16 is substantially sealed by an upper load cell element 24 which is structurally connected to the post by means of one or more bolts or screws as will be seen in FIG. 3 and discussed below.

It has been determined through tests that the characteristics of the signage panel have a significant influence upon impact responsive flexibility of the delineator post assembly. The signage should obviously be constructed of a material having a composition that will not readily take a permanent set or be readily deformable in response to impact by a vehicle. It has been determined that a high impact resistant polymer material will function quite well as signage material but that metal signage should not be employed unless provided with spring-like resiliency. Further, the thickness of the signage panel can have a significant influence on the apparent stiffness of the delineator post assembly and is influenced by a number of variables including the height and width of the signage, the number of delineator posts that are employed to support the signage, and the length and inherent flexibility of the posts. Where high impact resistant polymer signage is employed for typical travelway delineation, using single posts, according to the preferred embodiment of this invention, the thickness of the signage material should be carefully controlled. If the signage for typical delineator assemblies is rather thick, such as having a thickness in the order of ¼ inch for example, the resulting delineator post assembly can have very stiff characteristics, that are quite similar to the characteristics of metal posts. In the event the polymer signage material is quite thin, i.e., in the order of 1/16th inch for example the delineator post assembly will be readily flexible, but the signage will tend to be permanently deformed or torn away from the post on impacts. It has been determined that signage panels of high density polyethylene composition and being in the order of ⅛th inch, 0.130 inches in thickness, will provide the delineator post assembly with adequate flexibility and yet resist significant damage to the signage panel when the post assembly is impacted It should be born in mind that the general signage dimensions set forth above is for the purpose of illustration only and is not intended to be taken as limiting the scope of the invention.

Figure 2A:
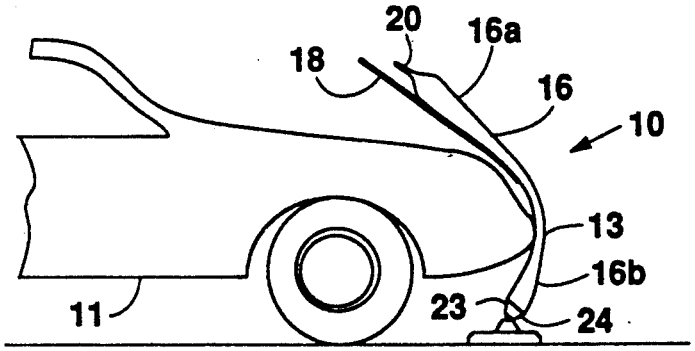
Figure 2B:
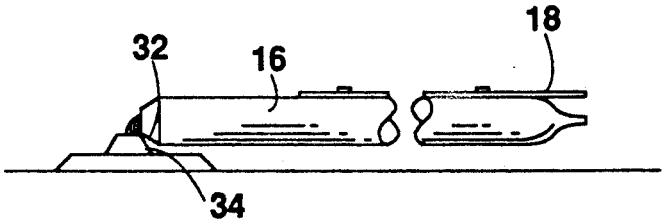
Figure 2C:
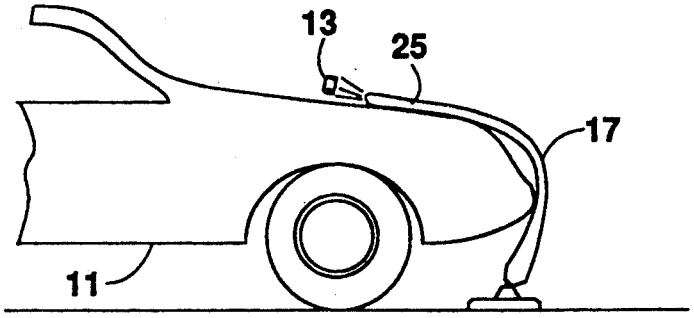

It should be understood that simply placing a watertight cap on the top 20 of tube 16 will not achieve the same result. The increased internal air pressure would simply displace the cap as shown at 13 in FIG. 2C. The sealing system of the closed top 20 and the other end of the tube must enable the post 16 to retain entrapped air when the tube 16 is impacted Sufficient internal pressure must be developed within tube 16 to pneumatically enhance he structural integrity and to thus assist the tube in returning to its original shape and to tend to push the tube away from an impacting vehicle traveling at high speeds. The sealing of the tube need not be such that no air escapes but merely that sufficient air is entrapped so as to result in a pneumatic air compression or dampening effect. FIGS. 2A–2C illustrate that upon impact by a vehicle 11, post 16 is forced by the impact to initially conform to the leading edge of the vehicle as air entrapped within post 16 is compressed in the immediate area 13 of impact. The upper portion **16*a* and the lower portion 16*b* of the post tube tend to expand in balloon-like fashion as the compressed air is forced upwardly and downwardly. The increased air pressure enhances the mechanical bending resistance of the post so that it does not bend sufficiently to cause the "wrap-around" effect shown in FIG. 2C. At the same time, load cell 24 begins to flex or bend in the direction of impact as will be discussed below. Thus, impact forces are absorbed by the pneumatically enhanced structural integrity of the post 16 and by the spring systems of the load cell 24**.

Because entrapped air in tube 16 is compressed and the composition of tube 16 has a memory, tube 16 is urged way from the loading edge of the impact. The tube 16 does not tend to lie against the vehicle 11 as shown in FIG. 2A. If a mere watertight cap 13 has been attached to tube end 25, it is easily popped out by the compressed air within tube 17, thereby releasing the air and providing no dampening effect.

It has been determined through tests that signage panels, upon being quickly pivoted from the upright position to the substantially horizontal position as the result of an automotive vehicle impact will cause a negative pressure or vacuum condition to develop on the front or vehicle-facing side of the signage panel. Further, during such pivotal movement, the side of the signage panel facing away from the vehicle will be opposed by the force of wind resistance. The combined forces of wind resistance and negative pressure tend to urge the signage panel toward the surfaces of the vehicle thereby creating the "wrap-around" effect discussed above. It has also been determined through tests that providing the signage panel with perforations will retard the effects of wind resistance and negative pressure development to thereby permit the structural integrity of the delineator post to maintain the signage panel substantially clear of the vehicle during downward pivoting of the delineator post and its signage. The perforations in the signage should be located and dimensioned to prevent lighting from the rear to interfere with clear visibility of the reflective and colored markings of the panel. As shown in FIG. 1, the signage panel 18 further has vent holes 17 in it. As the post 16 is initially bent by the impact force toward conformance with the configuration of the vehicle, panel 18 is pushed towards the vehicle surface by the force of wind pressure and drawn downwardly toward the vehicle by the negative pressure condition described above. The incorporation of vent holes 17 in the panel reduces the wind resistance and the negative pressure conditions and tends to keep the panel off of the vehicle. This is particularly important since the pneumatic action of the post tube is at the same time applying force to pull the signage panel away from the vehicle.

Figure 3:
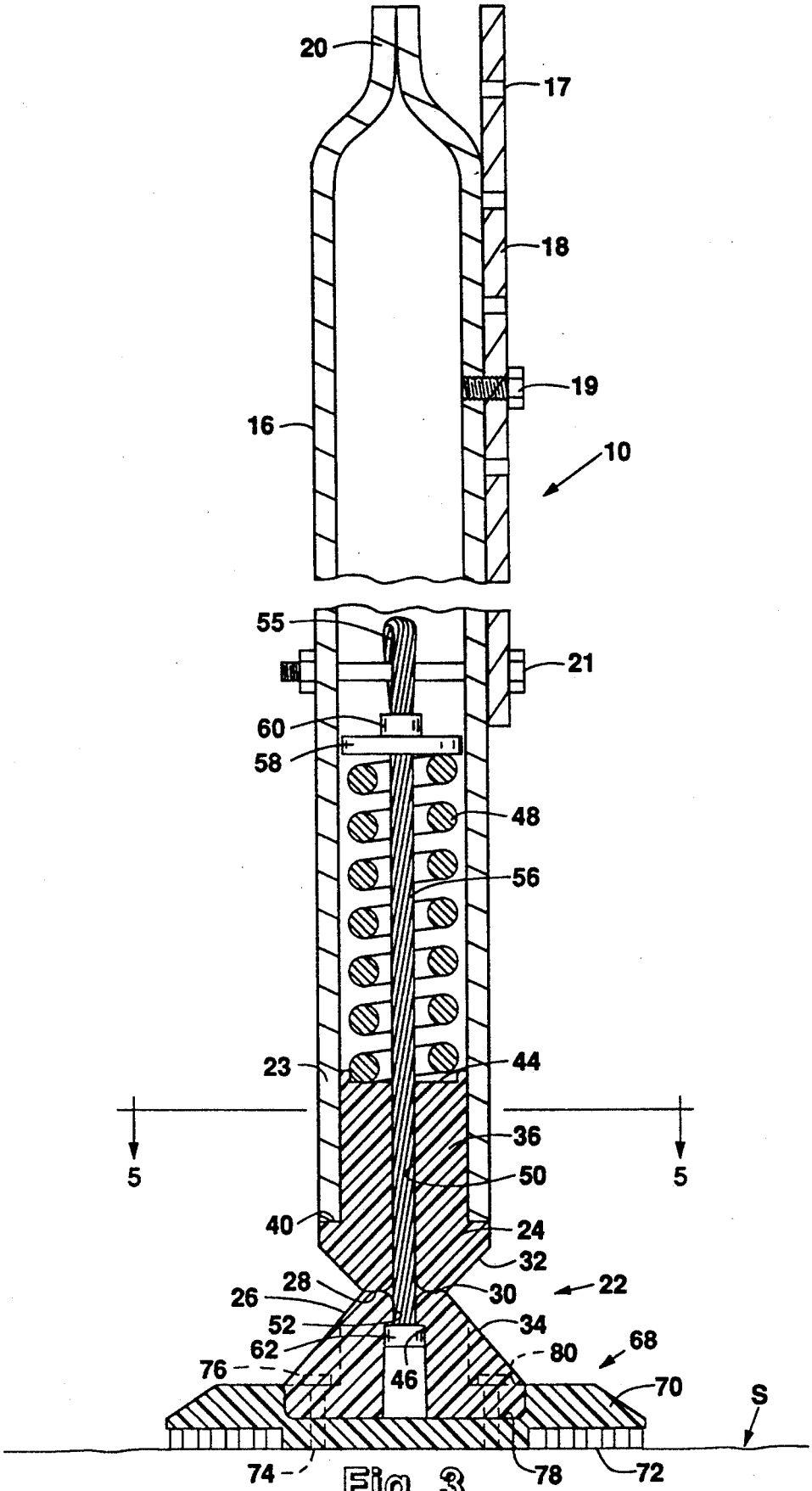

With reference now to FIG. 3, the self-uprighting delineator post construction of this invention incorporates a mounting base assembly, generally shown at reference 68, enabling the delineator post to be secured such as by means of epoxy bonding material to the ground, to a roadway or to other fixed objects. The mounting base assembly 68 is discussed in greater detail in connection with FIGS. 5–7.

As further shown in FIG. 3 and FIGS. 4A–4D, the self-uprighting delineator post system 10 is provided with at least one load cell illustrated generally at 22 having upper and lower load cell elements 24 and 26 that are normally positioned with respective generally planar abutment surfaces 28 and 30 in abutting engagement. The load cell elements 24 and 26 each define frusto-conical end surfaces 32 and 34 which are capable of coming into contact in the manner shown in FIGS. 2A and 2B as the load cell is yielded in response to an impact force applied to the post element 16. The upper load cell element defines a reduced diameter surface portion 36 that intersects larger diameter portions of the load cell elements in a manner forming abutment shoulder 40. The tubular delineator post 16 is received in close fitting relation about the cylindrical reduced diameter surface portion 36 and engages the abutment shoulder 40 in the manner shown in FIG. 3. The tubular element may be secured to the load cell element in any suitable fashion such as by screws, threading, etc. If desired, the fit between the tubular element 16 and the load cell element 24 may be in order of a friction fit. In the alternative, any other sort of connection means may be employed to establish a positively secured relationship between the tubular element and the load cell element so as to retain entrapped increased air pressure to induce internal pneumatic pressure within the post tube to increase the structural integrity of the post as discussed above.

As shown in FIG. 3 the load cell elements 24 and 26 define respective end recesses 44 and 47. The recess 44 functions as a spring recess to insure centralization of compression spring member 48. The recess 47 defines an internal shoulder 46 which functions as cable stop for cable stop sleeve 62.

Each of the upper and lower load cell elements 24 and 26 is formed to define a vertical central passage such as shown at 50 and 52. As is evident from FIGS. 4A–4D and FIG. 5, these vertical passages are of elongated cross-sectional configuration to thus provide for proper retention of side-by-side cable members 54 and 56. Tensile stress is applied to the cable 54 and 56 by the compression spring 48. A platform washer 58 is received about the cable and is retained by means of a cable stop sleeve member 60. A lower cable stop sleeve member 62 is secured to the opposite end of the cables 54 and 56 and is maintained in engagement with the stop surface 46 by the force applied by the compression spring 48. The platform washer 58 functions as a stop member for the upper end of the compression spring.

A safety loop 55 is formed with cables 54 and 56 and a retaining bolt 21 passes through the outer wall of tube 16, through the loop 55, and out the other end of tube 16 to secure the spring and load cell mechanisms within tube 16. This safety loop ensures that should the delineator post be unexpectedly torn or ripped from the base, the spring and load cell mechanisms will not be separated from the tube making its recovery more probable.

During assembly the compression spring 48 is initially compressed and the upper and lower cable stop sleeves 60 and 62 are swaged onto the cable ends and provide stops to maintain the cables under tension. This tension maintains the abutment surfaces 28 and 30 in contact thus maintaining the upper and lower load cell elements in properly aligned position. The abutment surfaces 28 and 30 are disposed in normal relation to the x-axis defined by the aligned passages 50 and 52. Thus when the abutment surfaces are in contact the passages 50 and 52 and thus the post 16 are vertically disposed. This feature causes the delineator post to be properly aligned with respect to the base assembly 68. The two cables, thusly tensioned extend through the elongated passages 50 and 52 of the upper and lower load cell elements along the x-axis and thus ensures that the post 16 always returns to its original position and the delineation surface of the post or its signage remains properly oriented. If the cables were extended through a circular passage, the cables could rotate and unwind when impacted, thereby releasing the compression on the spring that maintains the post rigid and upright. Through employment of dual side-by-side cables the load cell is permitted to bend efficiently in any direction at the load cell joint defined by the abutment surfaces 28 and 30 and the cables 54 and 56 are not permitted to unwind. Thus, the spring tension applied to the cables always remains constant as long as the positions of the cable stop sleeves 60 and 62 remain firmly established. Obviously the cable stop sleeves 60 and 62 may be applied to the cables by means other than swaging, but, a swaging operation is quite inexpensive and has been found to be quite effective. The dual cable arrangement also provides the impact recovery delineation system construction with capability of always righting itself to substantially the same position that the delineator post was in before being impacted. Thus the delineation surface which is mounted on a post and oriented to face towards oncoming traffic will not be disoriented after the post is impacted.

Because of the tapered surfaces 32 and 34 the load cell of the delineator post system is enabled to readily pivot to the position shown in FIG. 2B when the post is impacted. The post can be subjected to an impact force from any direction and yet recover substantially to is pre-impacted condition. Due to the pivoting displacement of the upper and lower parts of the load cell as the result of an impact force, the compression spring will become additionally loaded under compression, thereby storing energy for subsequent realignment of the upper and lower parts of the load cell. Obviously, during such realignment the delineator post is uprighted from the position shown in FIG. 2B to the position show in FIG. 1. The delineator post can be pivoted in excess of 90° and still return to its original upright position. As the load cell is yielded more than 90° the cables 54 and 56 simply travel further, thereby causing further compression of the spring member 48. As long as the spring member is not overstressed and the cable stops remain properly positioned the delineator post will always return to its upright properly oriented position after the impact force has diminished.

A load cell is illustrated generally at 22 which incorporates an upper load cell element 24 and a lower load cell element 26 which is supported by a base assembly shown generally at 68. The base assembly 68 incorporates a base plate 70 shown in FIGS. 5–7 forming a lower surface 72 that is prepared to be bonded to any suitable surface S, such as a roadway surface. The base plate 70 forms openings 74 which receive screw or bolt members 76 that extend through the lower load cell element 26 and secure the load cell element 26 to the base plate. The base plate 70 forms a receptacle 78 for the lower portion of the lower load cell 26 which has a retention flange 80 that secures and centralizes the lower load cell element and permits relative rotational positioning of load cell element 26 relative to the base assembly 68 to permit rotational adjustment of the post 16. The lower load cell element 26 forms a passage 52 of elongated cross-sectional configuration to receive the two cable members 54 and 56 in side-by-side relation. The lower load cell element is thus firmly secured by the base assembly 68.

Figure 4A:
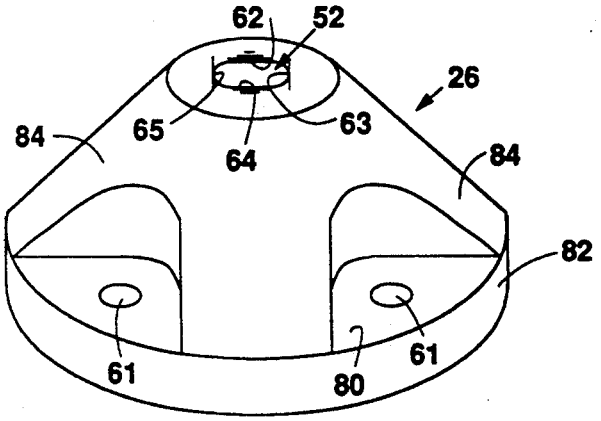

Both load cell elements 24 and 26 have been significantly improved in the present invention by modifying passages 50 and 52 as they exit the load cell elements at the flat planar abutment surfaces or faces 28 and 30, respectively. In FIGS. 4A–4B and FIG. 5 the passage modifications may be seen. Passages 50 and 52 in load cell elements 24 and 26 have a cross-section dimensioned in a first direction A slightly greater than a single cable diameter and in a second perpendicular direction B slightly greater than two cable diameters. When the delineator post system of the present invention is positioned along a highway the system is preferentially arranged so that traffic runs in direction A as shown in FIG. 4C.

Figure 4C:
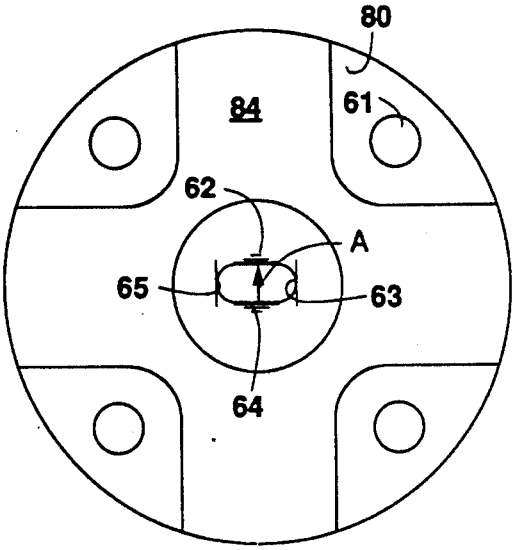
Figure 4B:
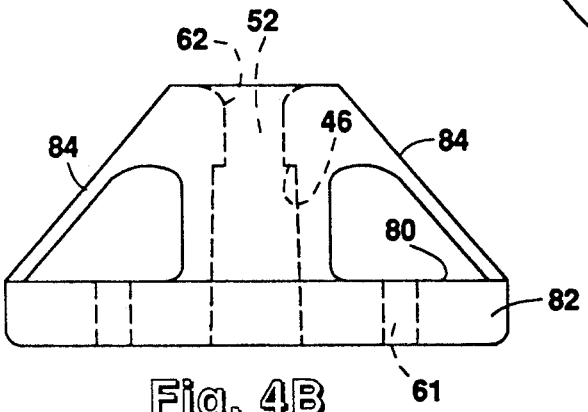
Figure 5:
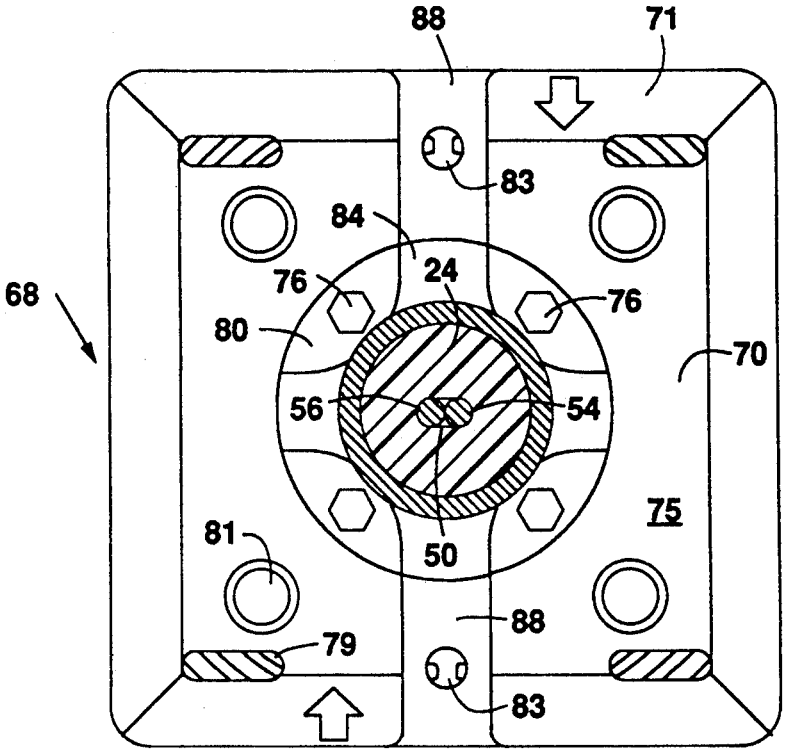

As may be clearly seen in FIGS. 4A–4C, the passage 52 in lower load cell element 26 is provided with radiused edges 62 and 64 extending in the second perpendicular direction along the flat abutment face 30 of element 26. The edges 63 and 65 extending in the first direction along the flat abutment face 30 are straight or sharp. In the same way passage 50, in upper load cell element 24, is provided with radiused edges extending in the second perpendicular direction along the flat abutment surface 28 and the edges of passage 50 extending in the first direction along the flat abutment face 28 are straight or sharp. This unique arrangement of the edges of the vertically aligned passages 50 and 52 minimizes the bending radius of the cables and thus improves the ability of the post to pivot upon impact and to return to its upright position with the post and signage in its original orientation with respect to the traffic flow. The force required to cause the load cell to pivot horizontally upon impact is considerably less than is now required with load cells having straight edges in both the first and second directions along the flat abutment faces. In a like manner, the compression spring forces more easily upright the posts in the present invention.

Bending or pivoting the post assembly will take place only along the x-axis of the delineator post and may occur omnidirectionally by impact from any direction. Regardless of the direction from which the delineator post is struck it will yield in the manner shown in FIG. 2B. The overall improvements of the present invention over existing devices further derives from the design of the lower load element 26. Existing devices have utilized an outer circumferential flange which runs around the entire base of the load cell element. Turning to FIGS. 4A–4D, it may be seen that in the present invention that the lower load cell element 26 has the general configuration of the frustum of a cone with recesses formed thereabout so as to define four retention flanges 80 positioned equidistance around the outer circumference of the base 82. Tapering wall segments 84 extend from the flat planar abutment face 30 to the base 82 and are spaced between the retention flanges. The tapering wall segments 84 are set at 45° from the horizontal and functions to deflect forces upwardly to reduce the shearing of the element on impact. The greater wall area provided by the present design adds more surface area for the distribution of impact energy. The design of element 26 with the extended wall segments provide additional structural strength and integrity to the element. Element 26 is able to withstand higher energy impacts without being damaged than are elements with a continuous circumferential retention flange.

Each of the four retention flanges 80 are provided with openings 61 for receiving suitable fasteners to secure element 26 to base plate 70 of assembly 68.

Figure 4D:
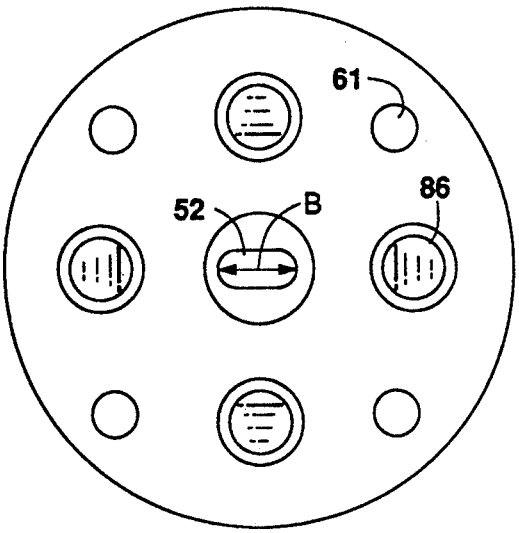

FIG. 4D illustrates a bottom view of element 26 showing passage 52, openings 61, and orientation recesses 86. Recesses 86 are positioned along the same axis as direction B and are depressions in the bottom of element 26 adapted to receive orientation lugs 89 or projections on base plate 70. Essentially the recesses and lugs facilitate aligning passage 52 in a proper orientation with base plate 70 when the delineator system is installed on a highway.

FIG. 5 shows a partial sectional view of the present invention taken along line 5—5 of FIG. 3. Base plate 70 is marked with traffic flow indicators (arrows) along two of its sloping edges 71 and 72 to indicate to the installer the proper orientation of the base assembly 68 on the highway. Such an orientation places vertical passages 50 and 52 with the radiused edges in the preferred position.

The present state of the art uses a base which is chemically bonded to the surface. Where the base is composed of a polymer material this chemical bonding is typically not sufficient to withstand the forces of high speed vehicular impacts.

To provide for mechanical and chemical bonding of polymer delineator bases to road surface materials, elongated openings 79 are formed in base plate 70 and extend from the top 75 of the plate 70 to the bottom 77 of plate 70. Elongated openings 79 are on the leading and trailing sides of plate 70. Countersunk rivet openings 81 and upper channel openings 83 are intended to allow epoxy or other adhesives placed on the road surface to flow from beneath plate 70 up through plate 70 via openings 79, 81, and 83 to the top surface 75 of the plate 70 and into upper channel 88. When the epoxy hardens a multiplicity of rivet-like fasteners are formed to mechanically secure the base plate to the surface. Thus the base assembly 68 is both chemically and mechanically bonded to the surface. FIGS. 6A and 6B illustrate an elevation view of unitary, one piece plate 70 with receptacle 78 for element 26, openings 79, 83, and 81. FIG. 6B is shown in section to illustrate the configuration of the recess within which he lower load cell element 26 is received.

An improved epoxy channeling system on the bottom of plate 70 is shown in FIG. 7. A series of concentric grooves or rings 85 with interconnecting channels 87 is formed in the bottom of plate 70. Epoxy placed on the road or highway surface is quickly and evenly distributed to the entire underside of plate 70 by the grooves 85 and interconnecting channels 87 when plate 70 is pressed firmly toward the road surface. Excess epoxy is forced upwardly through openings 79, 81, and 83 as previously discussed to form epoxy interlocking rivet-like fasteners as described above to form an improved bonding and adhesion to the road surface.

A stand-alone, portable base assembly 90 is illustrated in FIG. 8. A flexible base pad 91 which is formed of rubber or any one of a number of suitable rubber-like or flexible materials serves as the member in contact with the road surface. A stiffener plate 94 is secured to the rubber pad 91 on the top bottom or within the pad. Pad 91 has a length dimension of greater than the width dimension. The base assembly is to be placed lengthwise in the direction of traffic flow as shown by the arrow in FIG. 8. The leading 92 and trailing 93 ends of pad 91 extend significantly beyond the respective ends of the stiffener plate to provide the portable base with greater flexibility at the ends thereof. The flexible ends of the portable base pad are flexible to keep these ends from lifting from the road surface when the delineator post system is impacted. The flexibility of these ends is sufficient to allow the compression spring and load cell mechanism to pivot the post horizontally without lifting the leading or trailing edges of the portable base pad from the road surface. The primary function of the stiffener plate 94 is to transfer any overturning moment from the load cell to some distance away from the load cell in order to eliminate the lifting of the vehicle-facing end of base and the overturning of the system. The leading 92 and trailing 93 ends of pad 91 may be provided with weighting material 100 to provide additional counter weight to ensure that the ends of the pad do not lift from the roadway surface when the delineation system is impacted.

The portable base pad is provided with a centrally located recess within which the stiffener plate or other load cell connector is located. This recess positions the lower portion of the lower load cell below t he upper surface of the flexible pad and thus assists the structure in establishing a low center of gravity for the load cell and delineator.

In a suitable embodiment of this invention the lower load cell element 26 is attached to an elongated, generally rectangular metal stiffener plate 94 by means of a support plate 95 and fasteners 96 as shown in FIG. 8. Base plate 94 is further attached by fastener 97 to pad 91.

The bottom 98 of pad 91 is provided with a treat pattern to reduce slippage or movement of the portable base assembly when it is placed on the road surface.

Referring now to FIG. 9, an alternative embodiment of the present invention is illustrated generally at 102 and incorporates a generally rectangular elongate flexible portable base 104 which is composed of rubber or any one of a number of suitable rubber-like materials. Centrally of the base pad 104 is defined an opening 106 which intersects a recess 108 provided in the lower portion of the base pad 104. A metal stiffener plate 110 is positioned within the recess 108 and is secured in position by means of a plurality of retainer bolts 112 which are received within threaded openings in the stiffener plate. When thus positioned, the stiffener plate 110 is exposed at the central opening 106. The lower load cell element 26 is positioned within the opening 106 and is retained in intimate assembly with the metal stiffener plate by means of a plurality of bolts 114 that extend through the opening 61 of the flanges 80 of the lower load cell. The lower load cell 26 is thus recessed within the central opening 106 and is located as near the roadway surface as is practical, thus maintaining the center of gravity of the portable base assembly very low to thus enhance the capability of the portable base to maintain is contact with the roadway surface during impact by automotive vehicles.

It has been determined through testing activities that the elongate flexible portable base of this invention should provide a counterbalancing force in order to minimize lifting of the vehicle-facing end of the base from its support surface thus preventing the vehicle-facing end from being contacted by the undercarriage of the vehicle. When so contacted, obviously the base structure can be damaged and the undercarriage of the vehicle can also suffer damage. As the delineator post is struck by the front end of the vehicle it is pivoted downwardly. The force being imparted through the delineator post through the portable base tends to pivot the base about the end opposite the contact area between the vehicle and post. Thus the forces being imparted to the base are both lateral and vertical, tending to shift the base in the direction of the vehicle and downward as the delineator post is pivoted over during vehicle passage. These lateral and downward forces develop a pivot-like activity which tends to lift the vehicle-facing end of the base and to force the opposite end downwardly. A counterbalancing force to oppose lifting of the vehicle-facing end of the base can be achieved in several ways such as by providing the ends of the base with additional weight which can be attached to the base or combined within the material of the base. Additionally, counterbalancing forces can be developed through the rubber-like material of the base by appropriately adjusting the thickness and length of the base to counterbalance the base lifting forces. Additionally, the placement of the central stiffening portion of the base together with the location of the load cell is pertinent so as to maintain the base assembly with a low center of gravity. Accordingly, the "counterbalancing means" as set forth in this application is intended to encompass any one or a combination of these features within the spirit and scope of the present invention.

The opposed ends of the flexible base pad 104 extend well beyond the respective ends of the metal stiffener plate 108 and may be weighted in any suitable manner to maintain the ends of the flexible pad in contact with the roadway surface while sufficient force is being imparted to the delineator post to actuate the load cell and position the post substantially horizontally to permit unhindered vehicle passage. For example, the ends of the pads 102 may be loaded with lead shot 116 that is impregnated within the elastomeric material of the pad.

It is therefore clearly evident that the present invention is one well adapted to obtain all of the objects and advantages hereinabove set forth together with other objects and advantages that are inherent from a description of the apparatus itself.

It will be understood that certain combinations and subcombinations are of utility and may be employed without reference to other features and subcombinations. This is contemplated by and is within the scope of the present invention.

As many possible embodiments may be made of this invention without departing from the spirit and scope thereof it is to be understood that all matters hereinabove set forth are shown in the accompanying drawings are to be interpreted as illustrative and not in any limiting sense.

What is claimed is:

1. A self-uprighting delineation system comprising:

(a) a base means adapted to be supported by any suitable structure;

(b) a tubular delineator post of polymer composition;

(c) a pivotal load cell having supported connection with said base member and having supporting connection with said delineator post and further comprising:

(1) upper and lower load cell elements, each having a flat abutment face disposed in abutting relation and forming an abutment joint, said load cell elements each forming a cable passage, cross-section dimensioned in a first direction slightly greater than a single cable diameter and in a second perpendicular direction slightly greater than two cable diameters, said cable passage having radiused edges intersecting said flat abutment faces in said second perpendicular direction and having straight edges along said flat abutment faces in said first direction, said radiused edges and said straight edges cooperating such that said upper load cell element is capable of preferably pivoting in alignment with said first direction at said abutment joint relative to said lower load cell element;

(2) a pair of wire rope cables disposed in close fitting side-by-side relation and extending through said vertically aligned passages of said upper and lower load cell elements, said wire rope cables being capable of bending as said upper load cell is pivoted at said abutment joint and resisting tensile elongation and cooperating with said radiused edges and said straight edges to prevent relative rotation of said load cell elements while minimizing the bending and uprighting force required to pivot said upper load cell element in said first direction at said abutment joint relative to said lower load cell element; and (3) at least one compression spring placing said wire rope cables under predetermined tensile load, said compression spring being further compressed upon pivoting of said upper load cell element in either of said first and second directions and developing an uprighting force urging said upper and lower load cell elements and said delineator post to the vertically aligned and properly oriented positions thereof.

2. The self-uprighting delineation system of claim 1, wherein said lower load cell element is of generally frustoconical configuration and defines a plurality of peripheral recesses forming a plurality of tapering wall segments and retention flanges in said lower load cell element, positioned alternatingly and equidistant about the outer circumference thereof, said retention flanges having holes therein to receive fasteners for connection of said lower load cell element to said base means, said tapering wall segments providing said lower load cell element with resistance to shear force.

3. The self-uprighting delineation system of claim 1, wherein:

said base means includes a generally rectangular base member composed of generally rigid material and having a lower bonding surface defined by a plurality of spaced ridges defining first channels therebetween, said spaced ridges being interrupted to define lateral interconnecting channels having communication with a plurality of said first channels whereby upon forcible contact of uncured bonding material by the lower surface of said base said bonding material will readily flow into and substantially fill all of said first channels, said base further defining bonding recesses opening from the upper surface of said base and intersection at least some of said first channels, whereby said forcible contact induces bonding material to flow from said first channels into said recesses and upon curing to form mechanical interlocking retention as well as bonded retention with said base member.

4. The self-uprighting delineation system of claim 3, wherein:

said base member defines a plurality of connector openings extending from said upper surface to said lower surface and defining upwardly facing internal shoulders, said connector openings being provided to selectively receive bolts for bolting connection of said base to a suitable structure and adapted alternatively to receive bonding material which, upon curing, establishes a mechanical interlocking relation between said base member and said bonding material.

5. The self-uprighting delineation system of claim 4, wherein:

said plurality of openings are disposed in intersecting relation with at least some of said plurality of spaced ridges and channels to thus promote the flow of uncured bonding material from said channels into said connector openings.

6. The self-uprighting delineation system of claim 1, wherein:

(a) said base means includes a unitary base plate, said base plate defining a centrally located upwardly facing receptacle;

(b) said load cell being positioned within said upwardly facing receptacle and being releasably secured to said base means; and (c) at least one lower load cell element orientation member being located within said upwardly facing recess and adapted to establish orienting interengagement with said lower load cell element such that said lower load cell element is oriented with said first direction of said cable passage being in parallel alignment with the direction of said pivoting.

7. The self-uprighting delineation system of claim 1, wherein said base means comprises:

(a) an elongate base means composed of resilient material and forming opposed sides and opposed ends;

(b) a generally rigid stiffener element also forming opposed sides and opposed ends and being fixed to and located centrally of said elongate base member to render the central portion of said elongate base member generally rigid, said opposed ends of said elongate base extending beyond respective ends of said stiffener element such that opposed end portions of said elongate base are of flexible nature, said elongate base member and stiffener elements cooperating to minimize the lifting of the vehicle-facing end of said elongated base member upon application of impact forces to said delineator post assembly and to define a portable delineator base assembly; and (c) said portable delineator post being supported in upright relation by said delineator base assembly.

8. The improvement of claim 7, including:

counterbalancing means being incorporated in said elongate base member and cooperating with said rigid stiffener element and said flexible nature of said opposed end portion to further prevent said lifting of said vehicle-facing end of said elongate base member in response to said application of said impact forces to said delineator post assembly.

9. The improvement of claim 8, wherein:

said counterbalancing means comprises weight means being provided at leading and trailing ends of said opposed end portions of said elongate base member with a section of said resilient material between said weight and said rigid stiffener element.

10. The improvement of claim 7, wherein:

(a) said elongate base member defines a downwardly opening recess in the lower portion thereof and forms a central opening extending from the upper side of said elongate base and intersecting said downwardly opening recess;

(b) said generally rigid stiffener element being located within said recess and having a central portion thereof exposed at said opening; and (c) said load cell of said delineator post being located within said opening and having the lower portion thereof supported by said generally rigid stiffener element.

11. The improvement of claim 10 wherein:

said elongate base defines a lower surface of non-skid configuration which is adapted to engage a flat supporting surface such as a roadway so that said base assembly is of portable nature for rapid deployment and removal.

12. The improvement of claim 1, including:

a signage panel being fixed to said delineator post and being of high impact polymer composition, said signage panel being formed to define a plurality of air vent openings permitting air interchange between opposed faces thereof as said delineator post is moved pivotally by impact forces and by said load cell.

13. The improvement of claim 1, including:

means for retaining said load cell and said delineator post in coupled relation should the same become disconnected as the result of an impact.

14. The improvement of claim 13, wherein:

(a) said wire rope cables form a loop; and (b) fastener means coupling said loop of said wire rope cables to said delineator post thus maintaining said load cell in assembly with said delineator post.

15. In a self-uprighting delineation system for travelways and the like and incorporating a delineator post of polymer composition having a load cell interconnected therewith, the improvement comprising:

(a) an elongate base member composed of resilient material and forming opposed sides and opposed ends;

(b) a generally rigid stiffener element also forming opposed sides and opposed ends and being fixed to and located centrally of said elongate base to render the central portion of said elongate base member generally rigid, said opposed ends of said elongate base member extending beyond respective ends of said stiffener element such that opposed end portions of said elongate base member are of flexible nature, said elongate base member and stiffener elements cooperating to minimize the lifting of the vehicle-facing end of said elongated base member upon application of impact forces to said delineator post assembly and to define a portable delineator base assembly; and (c) said delineator post being supported in upright relation by said delineator base assembly.

16. The improvement of claim 15, including:

counterbalancing means being incorporated in said elongate base member and cooperating with said rigid stiffener element and said flexible nature of said opposed end portion to further prevent said lifting of said vehicle-facing end of said elongate base member in response to said impact forces on said delineator post assembly.

17. The improvement of claim 16, wherein:

said counterbalancing means comprises weight means being provided at leading and trailing ends of said opposed end portions of said elongate base member with a section of said resilient material between said weight and said rigid stiffener element.

18. The improvement of claim 15, wherein:

(a) said elongate base member defines a recess in the lower portion of said elongate base member and forms a central opening extending from the upper side of said elongate base member and intersecting said recess;

(b) said generally rigid stiffener element being located within said recess and having a central portion thereof exposed at said opening; and (c) said load cell of said delineator post being located within said opening and having the lower portion thereof supported by said generally rigid stiffener element.

19. The improvement of claim 18, wherein:

said elongate base member defines a lower surface of non-skid configuration which is adapted to engage a supporting surface such as a roadway so that said base assembly is of portable nature for rapid deployment and removal.

20. In a self-uprighting delineation system for travelways and the like and incorporating a delineator post of polymer composition having a load cell interconnected therewith, the improvement comprising:

a generally rectangular base member composed of generally rigid material and having a lower bonding surface defined by a plurality of spaced ridges defining first channels therebetween, said spaced ridges being interrupted to define lateral interconnecting channels having communication with a plurality of said first channels whereby upon forcible contact of uncured bonding material by the lower surface of said base, said bonding material will readily flow into and substantially fill all of said first channels, said base member further defining bonding recesses opening from the upper surface of said base and intersecting at least some of said first channels, whereby said forcible contact induces bonding material to flow from said first channels into said recesses and upon curing to form mechanical interlocking retention as well as bonded retention with said base member.

21. The improvement of claim 20, wherein:

said base member defines a plurality of connector openings extending from said upper surface to said lower surface and defining upwardly facing internal shoulders, said connector openings being provided to selectively receive bolts for bolting connection of said base to a suitable structure and adapted alternatively to receive bonding material which, upon curing, establishes a mechanical interlocking relation between said base member and said bonding material.

22. The improvement of claim 21, wherein:

said plurality of openings are disposed in intersecting relation with at least some of said plurality of spaced ridges and channels to thus promote the flow of uncured bonding material from said channels into said openings.

23. The improvement of claim 20, wherein:

(a) said base member includes a unitary base plate, said base plate defining a centrally located upwardly facing receptacle;

(b) said load cell being positioned within upwardly facing receptacle and being releasably secured to said base member; and (c) at least one lower load cell element orientation member being located within said upwardly facing recess and adapted to establish orienting interengagement with said lower load cell element such that said lower load cell element is oriented with said first direction of said cable passage being in parallel alignment with the direction of said pivoting.

24. In a self-uprighting delineation system for travelways and the like and incorporating a delineator post having a load cell interconnected therewith, the improvement comprising:

(a) said delineator post being of polymer composition and of tubular configuration forming an internal air chamber;

(b) means closing and sealing the upper end of said tubular post sufficiently to resist the impact induced development of significantly increased internal air pressure within said air chamber;

(c) a portion of said load cell being received in close fitting relation within the lower end of said delineator post and thus providing a lower closure for said air chamber; and (d) upon impact by an object such as an automotive vehicle, said delineator post pivoting about said load cell and being deformed by the impacting force of said object thus increasing the pressure of air entrapped within said air chamber, said increased air pressure enhancing the structural rigidity of said delineator post and resisting post bending and deformation forces and enhancing the capability of said delineator post to return to its original configuration after said impacting force has diminished.

25. The improvement of claim 24 wherein said means closing the upper end of said delineator post comprises:

(a) upper post deformation that collapses the upper end of said post and brings the internal surface of said post into face-to-face relation; and (b) said internal face-to-face surfaces being disposed in sealed assembly such that the upper end of said delineator post defines a flattened configuration.

26. In a self-uprighting delineation system for travelways and the like and incorporating a delineator post having a load cell interconnected therewith to permit pivoting of the delineator post between upright and substantially horizontal positions responsive to impact thereagainst, the improvement comprising:

(a) a signage panel being removably secured to said delineator post and having a plurality of openings formed therein to permit air interchange between opposed sides of said signage panel during pivoting movement of said delineator post; and (b) said signage panel being of polymer composition and having a thickness so as to cooperate with said polymer delineator post to provide a delineator post assembly of flexible nature and to minimize damage to said signage panel during impact responsive pivoting and self-uprighting movement thereof.

27. The improvement of claim 26, wherein said signage panel is composed of high impact resistant polymer having a thickness in relation to said delineator post such that said self-uprighting delineation system is of predetermined flexibility and said signage is capable of accommodating repeated impacts with minimal damage thereto.

28. The improvement of claim 26, wherein:

(a) said delineator post is composed of a high impact resistant polymer and is of generally cylindrical tubular configuration and is provided with a closed upper end; and (b) said load cell forming a closure for the lower end of said delineator post.

29. A self-uprighting delineator system comprising:

(a) base member adapted to be supported by any suitable stationary object;

(b) a delineator post of polymer composition, said post having a means for sealing said post so as to enable said post to retain within said post air compressed therein as the result of a high energy impact upon said post;

(c) a pivotal load cell having supported connection with said base member and having supporting connection with said delineator post and further comprising:

(1) upper and lower load cell elements, each of said elements having a flat abutment face disposed in abutting relation and forming an abutment joint, said load cell elements each forming a vertical cable passage, said passage cross-section dimensioned in a first direction slightly greater than a single cable diameter and in a second perpendicular direction slightly greater than two cable diameters, said passage having radiused edges along said flat abutment faces in said second perpendicular direction and straight edges along said flat abutment faces in said first direction, said upper load cell element capable of pivoting at said abutment joint relative to said lower load cell element;

(2) a pair of wire rope cables disposed in close fitting side-by-side relation and extending through said vertically aligned passages of said upper and lower load cell elements said wire rope cables being capable of bending and resisting tensile elongation and cooperating with said geometric configuration of said aligned passages, said radiused edges and said straight edges to prevent relative rotation of said load cell elements while reducing the bending and uprighting force required to pivot said upper load cell element in said first direction at said abutment joint relative to said lower load cell element; and (3) at least one compression spring placing said wire rope cables under predetermined tensile load, said compression spring being further compressed upon pivoting of said upper load cell element in said first direction and developing an uprighting force urging said upper and lower load cell elements and said delineator post to the vertically aligned and properly oriented positions thereof.

* * * * *